US008370966B2

(12) United States Patent
Hendon et al.

(10) Patent No.: US 8,370,966 B2
(45) Date of Patent: Feb. 12, 2013

(54) ROOFING GLOVE

(76) Inventors: Luke Hendon, Suwanee, GA (US); Ray Hendon, Bonaire, GA (US)

( * ) Notice: Subject to any disclaimer, the term of this patent is extended or adjusted under 35 U.S.C. 154(b) by 168 days.

(21) Appl. No.: 12/762,873

(22) Filed: Apr. 19, 2010

(65) Prior Publication Data

US 2011/0252536 A1 Oct. 20, 2011

(51) Int. Cl.
*A41D 19/00* (2006.01)

(52) U.S. Cl. ..... 2/160; 2/161.6

(58) Field of Classification Search ..... 2/16, 159, 2/158, 160, 161.1, 161.3, 161.2, 161.6, 161.5, 2/161.4; 451/523, 461; 452/6, 17, 102, 103, 452/104, 105, 132, 145, 146
See application file for complete search history.

(56) References Cited

U.S. PATENT DOCUMENTS

| | | | | | |
|---|---|---|---|---|---|
| 183,375 | A | * | 10/1876 | Cutliff | 2/161.8 |
| 251,571 | A | * | 12/1881 | Glidden | 30/123.5 |
| 259,683 | A | * | 6/1882 | Hagen | 30/123.5 |
| 348,528 | A | * | 8/1886 | Ludwig | 30/123.5 |
| 572,751 | A | * | 12/1896 | Hanna | 2/455 |
| 730,051 | A | * | 6/1903 | Scott | 30/123.5 |
| 767,918 | A | * | 8/1904 | Thomas | 30/123.5 |
| 966,641 | A | * | 8/1910 | Atkinson | 30/123.5 |
| 1,243,622 | A | | 10/1917 | Nielsen | |
| 1,274,481 | A | * | 8/1918 | West | 2/20 |
| 1,333,792 | A | * | 3/1920 | Bunnell | 294/25 |
| 1,528,251 | A | * | 3/1925 | Fritzen | 30/123.5 |
| 1,583,605 | A | * | 5/1926 | Root | 449/44 |
| 1,583,754 | A | * | 5/1926 | Rogers | 294/25 |
| 1,863,483 | A | * | 6/1932 | Jackson | 30/431 |
| 2,278,610 | A | * | 4/1942 | Brownson et al. | 294/25 |
| RE22,167 | E | * | 8/1942 | Wells et al. | 2/161.8 |
| 2,524,979 | A | | 7/1949 | Kimbrell | |
| 2,616,745 | A | * | 11/1952 | Alston | 294/25 |
| 2,895,139 | A | * | 7/1959 | Compton | 2/161.8 |
| 2,954,832 | A | * | 10/1960 | Pirone | 172/370 |
| 2,980,915 | A | * | 4/1961 | Peterson | 2/159 |
| 3,236,553 | A | * | 2/1966 | Shrier | 294/25 |
| 3,417,840 | A | * | 12/1968 | Farnsworth, Jr. | 182/8 |
| 3,752,524 | A | * | 8/1973 | Reick, Jr. | 294/25 |
| 3,872,514 | A | * | 3/1975 | Liebelt | 2/159 |
| 3,981,526 | A | * | 9/1976 | Lundqvist | 294/25 |
| 4,038,787 | A | * | 8/1977 | Bianchi | 451/523 |
| 4,107,840 | A | * | 8/1978 | Kupperman et al. | 30/172 |
| 4,149,296 | A | * | 4/1979 | Stanford | 452/103 |
| 4,589,146 | A | | 5/1986 | Taylor | |
| 4,662,006 | A | * | 5/1987 | Ross, Jr. | 2/158 |
| 4,881,276 | A | * | 11/1989 | Swan | 2/161.1 |
| 5,282,616 | A | * | 2/1994 | Stacavich-Notaro | 473/406 |
| 5,644,796 | A | * | 7/1997 | Laughlin | 2/161.6 |
| 5,873,788 | A | | 2/1999 | Hoffman | |
| 6,122,770 | A | * | 9/2000 | Mathison et al. | 2/20 |
| 6,244,639 | B1 | * | 6/2001 | Storck | 294/25 |

(Continued)

*Primary Examiner* — Khoa Huynh
*Assistant Examiner* — Brieanna Fuller
(74) *Attorney, Agent, or Firm* — Bradley D. Crose; Crose Law LLC

(57) ABSTRACT

A roofing glove is provided. The roofing glove includes a fitted protective covering receivable to a hand of a user, at least one spike having an anchor and a sharp protrusion extending from the glove and narrowing at a distal tip, anchored within the covering at a first predetermined location, and at least one grip pad disposed upon the covering at a second predetermined location. The at least one spike and the at least one grip pad are adapted to grip a surface, or the like, upon a fall by the wearer of the glove to prevent further fall or slide.

15 Claims, 6 Drawing Sheets

U.S. PATENT DOCUMENTS

| | | | | |
|---|---|---|---|---|
| 6,374,417 | B1 | 4/2002 | Stagnitta | |
| 6,408,441 | B1 * | 6/2002 | Smith et al. | 2/161.6 |
| 6,604,244 | B1 * | 8/2003 | Leach | 2/161.6 |
| D517,278 | S * | 3/2006 | Chernick et al. | D2/615 |
| 7,114,222 | B2 * | 10/2006 | Lemire et al. | 24/370 |
| D536,487 | S | 2/2007 | Boribong | |
| 7,310,826 | B2 | 12/2007 | Kishihara | |
| D569,578 | S | 5/2008 | Yan | |
| D581,127 | S | 11/2008 | Bautista et al. | |
| D608,978 | S | 2/2010 | Votel | |
| 2010/0224443 | A1 * | 9/2010 | Broten | 182/3 |

* cited by examiner

ROOFING GLOVE

FIELD OF THE INVENTION

The technology described herein relates generally to the fields of hand gloves, traction devices, and safety and fall prevention devices. More specifically, this technology relates to a roofing glove having embedded, interchangeable fall prevention spikes and slip resistant pads.

BACKGROUND OF THE INVENTION

Persons such as roofers, chimney sweeps, gutter installers, and the like, are at risk of fall and injury when working on incline roofs or similar surfaces. Known solutions to protect persons and to prevent such hazards include toe boards, guardrails, and traction footwear, for example.

Gloves, generally, are known in the background art for protection of the hands, food preparation, fish cleaning and filleting, husking, and specialized sporting applications.

Related patents known in the art include the following: U.S. Pat. No. 730,051 issued to Scott on Jun. 2, 1903, discloses a husking glove or mitt. U.S. Pat. No. 1,243,622 issued to Nielson on Oct. 16, 1917, discloses a fisherman's glove. U.S. Pat. No. 2,524,979 issued to Kimbrell on Oct. 10, 1950, discloses a glove. U.S. Pat. No. 4,589,146 issued to Taylor on May 20, 1986, discloses a glove having a securing means for improved gripping. U.S. Pat. No. 5,873,788 issued to Hoffman on Feb. 23, 1999, discloses a grip control glove. U.S. Pat. No. 6,374,417 issued to Stagnitta on Apr. 23, 2002, discloses a food handling glove. U.S. Pat. No. 7,310,826 issued to Kishihara on Dec. 25, 2007, discloses a work glove. U.S. Pat. No. D581,127 issued to Bautista et al. on Nov. 25, 2008, discloses a fish filleting glove. U.S. Pat. No. D536,487 issued to Boribong on Feb. 6, 2007, discloses a safety glove. U.S. Pat. No. D569,578 issued to Yan on May 27, 2008, discloses a glove. U.S. Pat. No. D608,978 issued to Votel on Feb. 2, 2010, discloses an armored work glove.

The foregoing patent information reflects the state of the art of which the inventor is aware and is tendered with a view toward discharging the inventor's acknowledged duty of candor in disclosing information that may be pertinent to the patentability of the technology described herein. It is respectfully stipulated, however, that the foregoing patent and other information do not teach or render obvious, singly or when considered in combination, the inventor's claimed invention.

BRIEF SUMMARY OF THE INVENTION

In various exemplary embodiments, the technology described herein provides a device, system, and associated methods for a roofing glove having embedded, interchangeable fall prevention spikes and slip resistant pads.

In one exemplary embodiment, the technology described herein provides a glove. The glove includes: a fitted protective covering receivable to a hand of a user; at least one spike having an anchor and a sharp protrusion extending from the glove and narrowing at a distal tip, anchored within the covering at a first predetermined location; at least one grip pad disposed upon the covering at a second predetermined location, and a wrist strap wrap. The at least one spike and the at least one grip pad are adapted to grip a surface, or the like, upon a fall by the wearer of the glove to prevent further fall or slide. The wrist strap wrap is adapted to securely hold the glove on the wearer such that the glove is not pulled from the wearer in use when trying to break or impede the fall.

The spikes can be utilized, for example, on both a lower palmar side of the glove and a lower ulnar border side of the glove as worn on the hand. In one embodiment, the spikes include a pair of spikes on the lower palmar side of the glove as worn on the hand. In another embodiment, the spikes include a pair of spikes on the lower ulnar border side of the glove as worn on the hand. Alternative configurations of the spikes and placement locations are anticipated in various alternative embodiments.

The spikes are interchangeable and replaceable. The spikes can include a curvature adapted to break a fall and cease a slide on a sloped surface. Each spike can further include a fastener pin separable from a backing having a base. The fastener pin is adapted for access through a material to secure the spike to the base located on an opposite side of the material.

The grip pads are interchangeable and replaceable. The grip pads also can include at least one anchor disposed upon the fitted protective covering to secure the at least one grip pad to the fitted protective covering of the glove. Each anchor can be one of hook and loop fasteners. Each grip pad can be one of hook and loop fasteners, opposite of the anchors, such that the grip pad is securely attachable and interchangeable to the anchor on the glove.

In another exemplary embodiment, the technology described herein provides a roofing glove adapted for fall prevention and fall cessation. The roofing glove includes: a fitted protective covering receivable to a hand of a user with a separate sheath for each finger and the thumb; at least one palmar spike and at least one ulnar spike each having an anchor and a sharp protrusion extending from the glove and narrowing at a distal tip, anchored within the covering; and at least one grip pad disposed upon the covering. The at least one first spike is disposed on a lower palmar side of the glove. The at least one second spike is disposed on a lower ulnar border side of the glove.

Each of the palmar spike and ulnar spike are interchangeable and replaceable. Each of the palmar spike and ulnar spike also can include a curvature adapted to break a fall and cease a slide on a sloped surface. Each of the palmar spike and ulnar spike further can include a fastener pin separable from a backing having a base. The fastener pin is adapted for access through a material to secure the spike to the base located on an opposite side of the material.

Each grip pad is interchangeable and replaceable. Each grip pad also can include at least one anchor disposed upon the fitted protective covering to secure the at least one grip pad to the fitted protective covering of the glove. Each anchor further can include one of hook and loop fasteners. Each grip pad includes one of hook and loop fasteners, opposite of the anchors, such that the grip pad is securely attachable and interchangeable to the anchor on the glove.

In another exemplary embodiment, the technology described herein provides a method for fall prevention and cessation on a roof. The method includes: providing a glove structure having a fitted protective covering receivable to a hand of a user, at least one spike having an anchor and a sharp protrusion extending from the glove and narrowing at a distal tip, anchored within the covering at a first predetermined location, and at least one grip pad disposed upon the covering at a second predetermined location; wherein the at least one spike and the at least one grip pad are adapted to grip a surface, or the like, upon a fall by the wearer of the glove to prevent further fall or slide; and utilizing, upon a fall or slide, the glove and at least one spike and at least one grip pad to break or cease the fall.

The method can also include inhibiting further slide on a sloped surface by embedding the at least one spike into the sloped surface. The method further can include inhibiting further slide on a sloped surface by applying the at least one grip pad directly to the sloped surface.

Advantageously, the technology described herein provides a vastly improved work glove for roofers, and the like, that provides increased safety with embedded, interchangeable fall prevention spikes and slip-resistant pads. As either of the spikes or pads is worn and needs replaced, replacement is made easy.

Also advantageously, the roofing glove provides a strong wrist-strap wrap to ensure that during use, such as while embedding the spikes and pads into a roof to break a fall or slide, the gloves are not pulled from the wearer.

There has thus been outlined, rather broadly, the more important features of the technology in order that the detailed description thereof that follows may be better understood, and in order that the present contribution to the art may be better appreciated. There are additional features of the technology that will be described hereinafter and which will form the subject matter of the claims appended hereto. In this respect, before explaining at least one embodiment of the technology in detail, it is to be understood that the invention is not limited in its application to the details of construction and to the arrangements of the components set forth in the following description or illustrated in the drawings. The technology described herein is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the technology described herein.

Further objects and advantages of the technology described herein will be apparent from the following detailed description of a presently preferred embodiment which is illustrated schematically in the accompanying drawings.

BRIEF DESCRIPTION OF THE DRAWINGS

The technology described herein is illustrated with reference to the various drawings, in which like reference numbers denote like device components and/or method steps, respectively, and in which.

DETAILED DESCRIPTION OF THE INVENTION

Before describing the disclosed embodiments of this technology in detail, it is to be understood that the technology is not limited in its application to the details of the particular arrangement shown here since the technology described is capable of other embodiments. Also, the terminology used herein is for the purpose of description and not of limitation.

In various exemplary embodiments, the technology described herein provides a device, system, and associated methods for a roofing glove having embedded, interchangeable fall prevention spikes and slip resistant pads.

Figure 1:
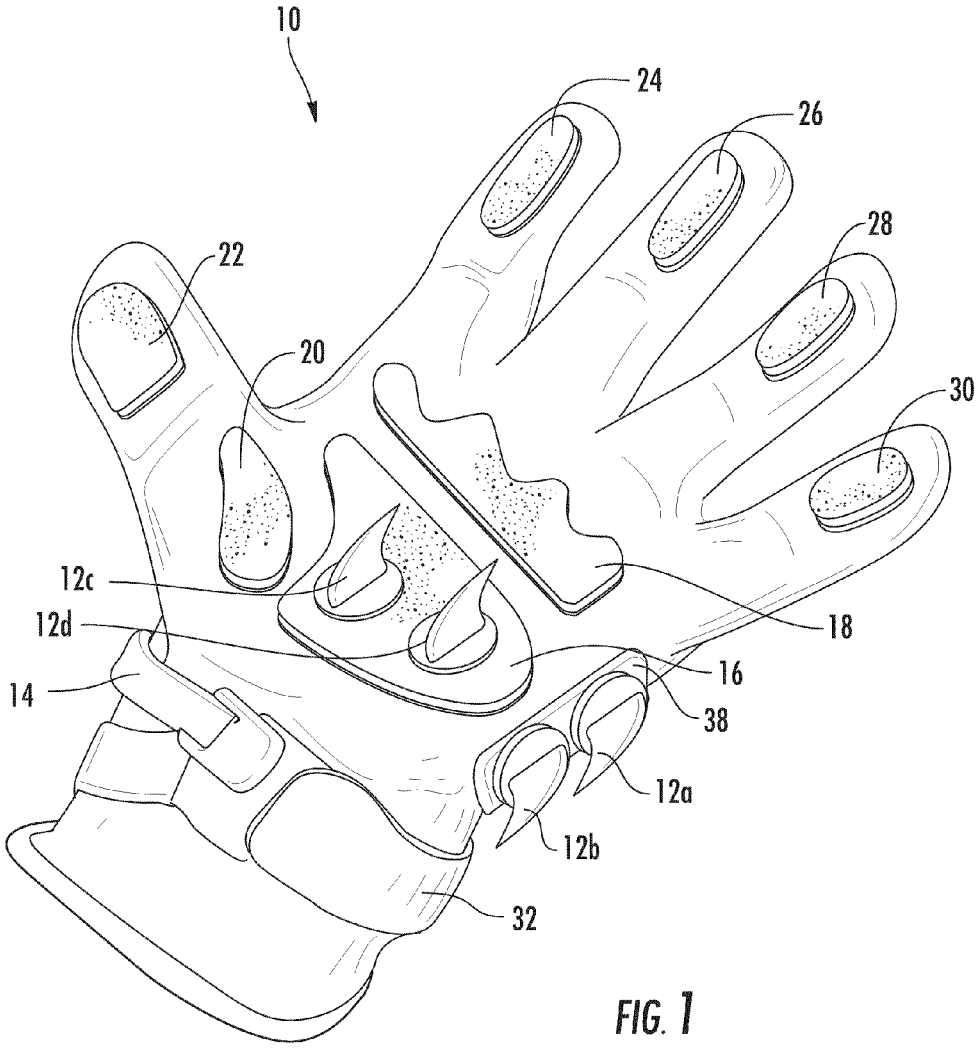
FIG. 1 is a front perspective view of a roofing glove, illustrating, in particular, the left-hand glove, palmar side having a multiplicity of embedded, interchangeable fall prevention spikes and slip resistant pads, according to an embodiment of the technology described herein.
Figure 2:
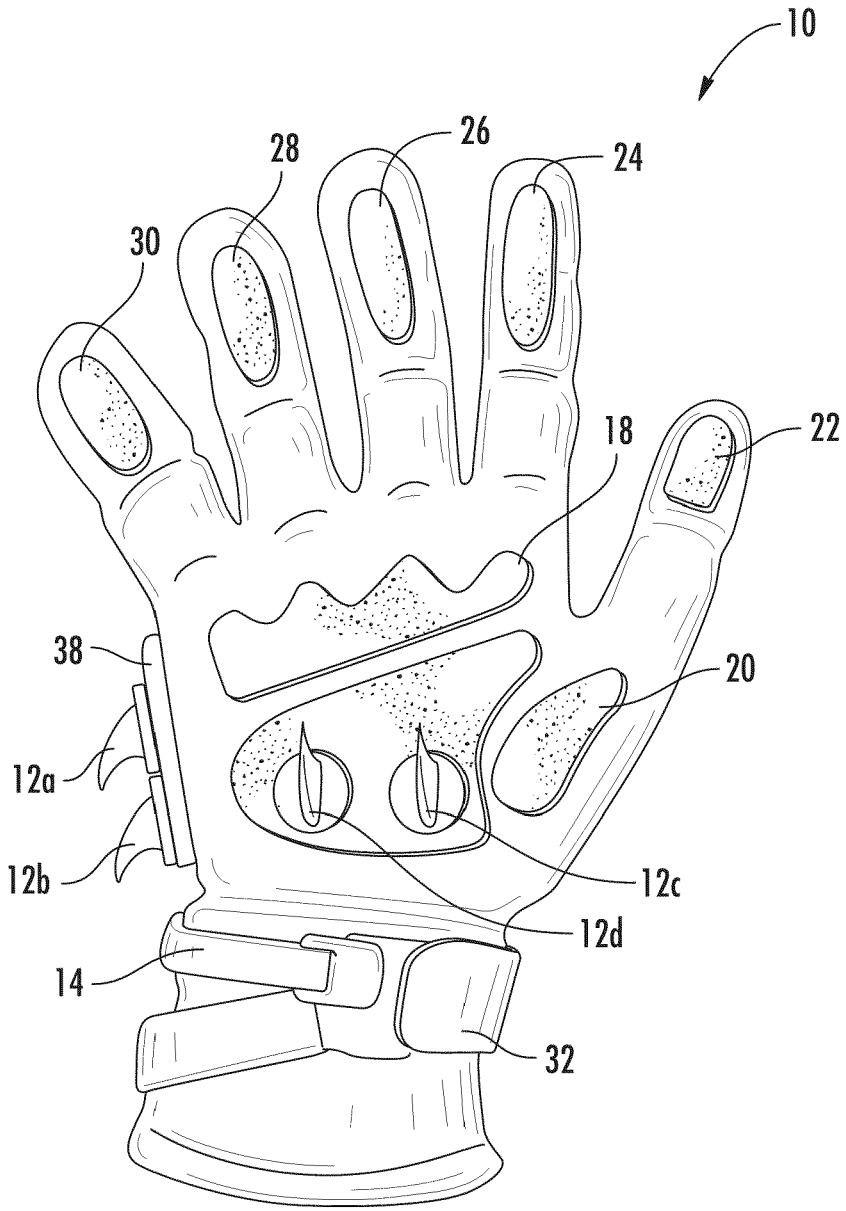
FIG. 2 is a front planar view of a roofing glove, illustrating, in particular, the right-hand glove, palmar side having a multiplicity of embedded, interchangeable fall prevention spikes and slip resistant pads, according to an embodiment of the technology described herein.
Figure 3:
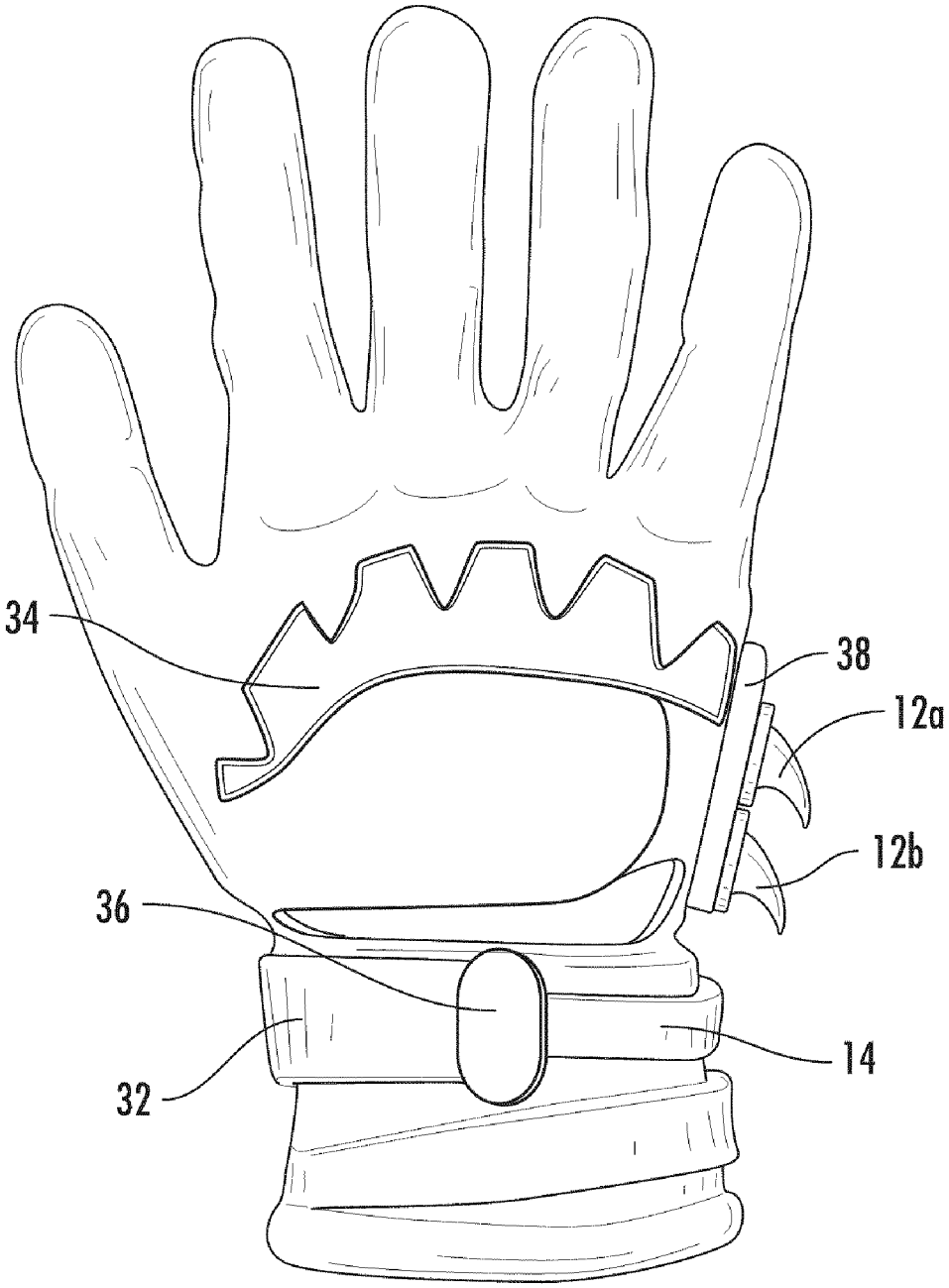
FIG. 3 is a front planar view of the roofing glove, right-hand glove depicted in FIG. 2, illustrating, in particular, the dorsal side, dorsal reinforcement, and pad wrist strap, according to an embodiment of the technology described herein.
Figure 4:
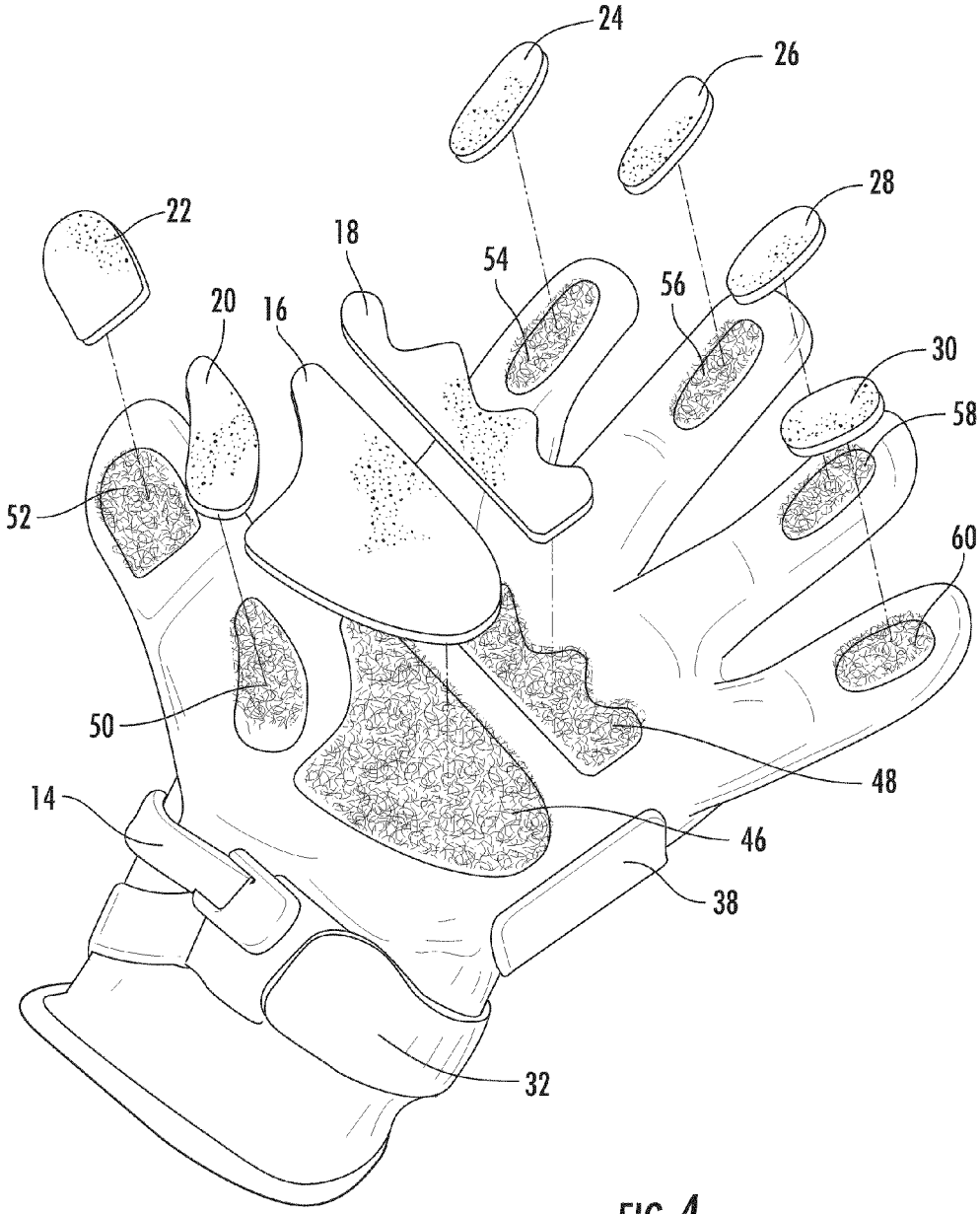
FIG. 4 is an exploded view of the roofing glove depicted in FIG. 1, illustrating, in particular, the interchangeable slip resistant pads and a means of attachment, according to an embodiment of the technology described herein.

Referring now to the Figures a roofing glove 10 is shown. As depicted, specifically in FIG. 1, a left hand glove 10 is shown from the palmar side. In FIG. 2, a right hand glove 10 is depicted from the palmar side. In FIG. 3, a right hand glove 10 is depicted from the dorsal side. In FIG. 4, an exploded view of the glove components is shown, illustrating at least one means of attachment of the interchangeable grip pads to the glove 10.

The glove 10 is a fitted protective covering receivable to a hand of a user. The glove 10 depicted in the Figures includes a separate sheath for each small, ring, middle, and index finger and the thumb. The fitted protective covering of the glove 10 can be manufactured from various materials. By way of example, the glove 10 can be manufactured from a durable leather material.

The glove 10 can include a variety of structural reinforcement components to provide strength and additional protections to the wearer. By way of example, one or more dorsal pads 34 can be used to provide protection to the wearer on the dorsal side of the hand. The dorsal pad 34, for example, can provide protection to the knuckles and metacarpals.

The glove 10 includes at least one spike 12. Each spike 12 can vary in configuration, material of manufacture, curvature, size, means of attachment to the glove 10, and the like. By way of example, and as depicted, each spike 12 is anchored to the glove 10 by an attachment means and has a sharp protrusion extending from the glove 10 and narrowing at a distal tip. Each spike 12 is adapted to grip a surface, or the like, upon a fall by the wearer of the glove 10 to prevent further fall or slide. In at least one embodiment, the spike 12 is a heavy-duty metal material. It is to be understood that the spikes 12 are replaceable and interchangeable, and that the glove 10, optionally can be worn with one or more spikes 12 removed.

Placement locations for each spike 12 on the glove 10 can vary. However, the glove 10 is designed with both safety and practicality in mind. While the objectives of safety are met with the spikes 12, the wearer of the glove 10 must not be unnecessarily impeded from typical work. As depicted the spikes 12 are located on the glove 10 in a manner that still allows a wearer full use of the fingers, thumb, and hand portions for movement, flexibility, and the like, without interference or harm from the spikes 12. By way of example, a roofer can wear the glove 10 and perform normal roofing tasks all the while accessibility to the spikes 12 is nearly immediate should the roofer need to break or cease a fall. The direction in which the spikes 12 point also can vary. A wearer can adjust the direction of the spikes 12 and rotate the spikes for varied use.

The spikes 12 can be utilized, for example, on both a lower palmar side of the glove 10 and a lower ulnar border side of the glove 10 as worn on the hand. In one embodiment, the spikes 12 include a pair of spikes 12*c*, 12*d* on the lower palmar side of the glove 10 corresponding to the lower palmar regions over the thenar and hypothenar as worn on the hand. In another embodiment, the spikes 12 include a pair of spikes 12*a*, 12*b* on the lower ulnar border side (an outermost edge of the ulnar side situated below fingers and above wrist of the inserted hand as shown in FIGS. 1-2) of the glove 10 as worn on the hand. Alternative configurations of the spikes 12 and placement locations are anticipated in various alternative embodiments.

Figure 5:
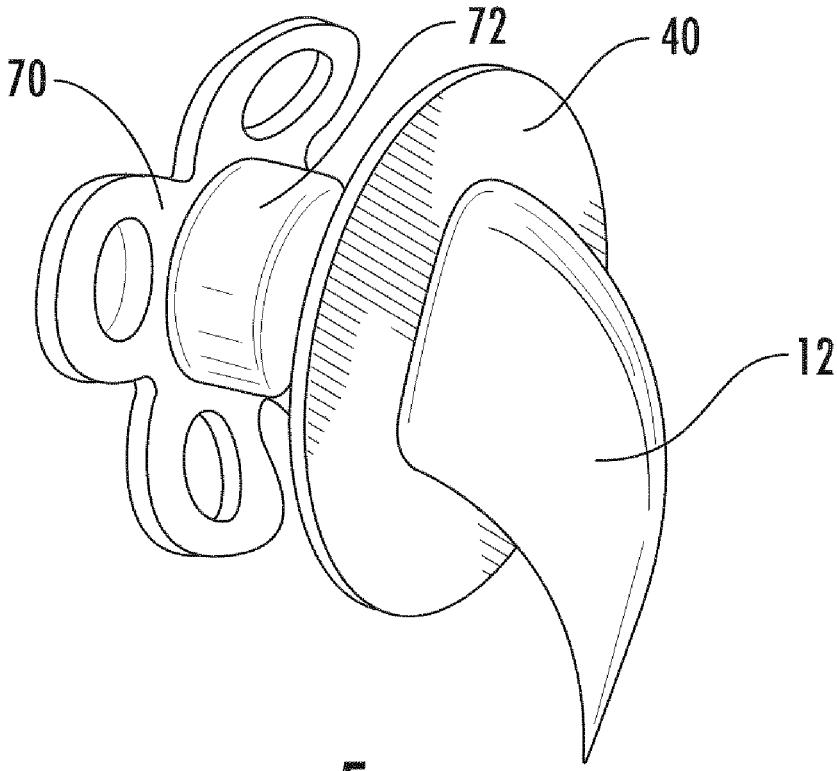
FIG. 5 is a front perspective view of a fall prevention spike, according to an embodiment of the technology described herein.
Figure 6:
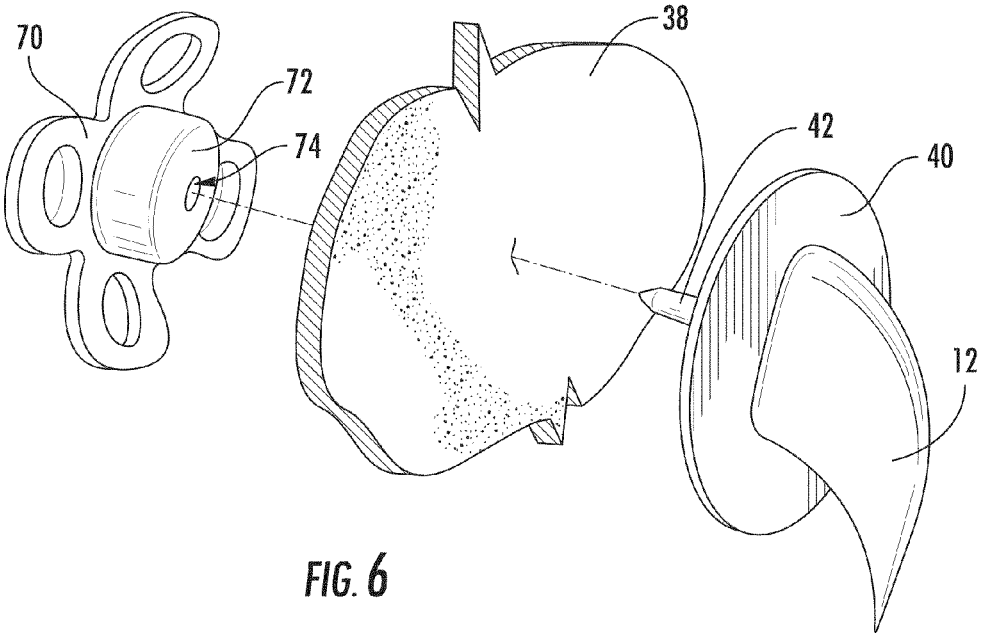
FIG. 6 is a front perspective view of the fall prevention spike depicted in FIG. 5, illustrating, in particular, a means of attachment according to an embodiment of the technology described herein.
Figure 7:
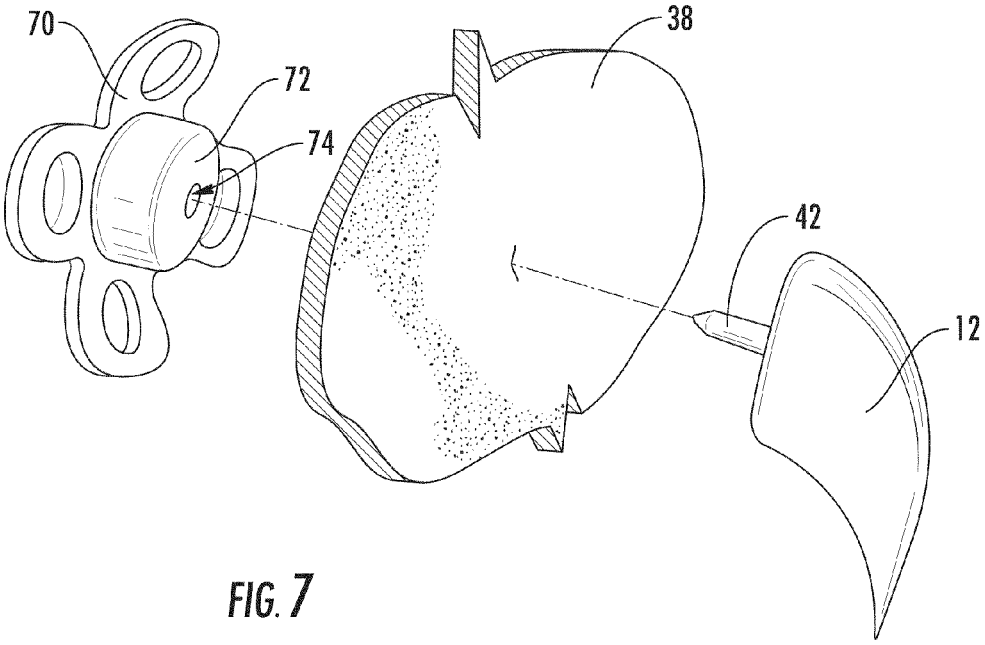
FIG. 7 is a front perspective view of a fall prevention spike, illustrating, in particular, a means of attachment according to an embodiment of the technology described herein.

The spikes 12 are interchangeable and replaceable. The spikes 12 can include a curvature, as depicted specifically in FIGS. 5, 6, and 7, adapted to break a fall and cease a slide on a sloped surface. In this embodiment, the curvature of the spike 12, provides a hooking function, useful to, for example, a roofer sliding down or falling from a roof. In such a circumstance, the roofer can use body weight and pressure on the hands to thrust the spikes into the sloped roof surface. The spikes 12 of the lower palmar regions include a first sharp protrusion extended from the glove 10 and narrowed at a first distal tip, the first sharp protrusion consisting of a first curvature, curved upwardly in a direction toward a fingertip area and the spikes 12 of the ulnar border side include a second sharp protrusion extended from the glove 10 and narrowed at a second distal tip, the second sharp protrusion consisting of a second curvature, curved downwardly in a direction toward a wrist area as depicted in FIGS. 1-2. The spikes 12 can also be without curvature, or varying degrees of curvature. Each spike 12 can further include a fastener pin 42 separable from a backing 70 having a base 72 and a receiving aperture 74. The fastener pin 42 is adapted for access through a material, such as spike pad 38, to secure the spike 12 to the base 72 located on an opposite side of the spike pad 38. In at least one embodiment, and as depicted specifically in FIG. 6, the spike 12 configuration can include a spike plate 40 to provide additional structural integrity to the spike 12. Additionally, the spikes 12 can utilized a spike pad 38 to provide further structural integrity to attach to the glove 10.

The glove 10 includes at least one grip pad, such as pads 16-30 depicted in the Figures. Each grip pad 16-30 can vary in configuration, material of manufacture, size, shape, means of attachment to the glove 10, and the like. In at least one embodiment, each grip pad 16-30 includes durable foam adapted with superior gripping and traction. Each grip pad 16-30 is adapted to grip a surface, or the like, upon a fall by the wearer of the glove 10 to prevent further fall or slide.

Placement locations for each grip pad 16-30 on the glove 10 can vary. However, the glove 10 is designed with both safety and practicality in mind. While the objectives of safety are met with each grip pad 16-30, the wearer of the glove 10 must not be unnecessarily impeded from typical work. As depicted each grip pad 16-30 is located on the glove 10 in a manner that still allows a wearer full use of the fingers, thumb, and hand portions for movement, flexibility, and the like, without interference from the grip pads 16-30. By way of example, a roofer can wear the glove 10 and perform normal roofing tasks all the while accessibility to the grip pads 16-30 is nearly immediate should the roofer need to break or cease a fall.

As depicted in the Figures a lower palmar pad 16 covers the lower palmar regions such as the thenar and hypothenar. As shown, the lower palmar pad 16 also serves as an attachment area for spikes 12*c*, 12*d*. Upper palmar pad 18 covers the upper or distal palmar regions nearer the digits. Thenar pad 20 covers the thenar region. Thumb pad 22 covers the distal thumb area. Grip pads 24, 26, 28, 30 each cover the index, middle, ring, and small fingers. The grip pads 24, 26, 28, 30 are shown to cover the distal end of each, finger; however, in various embodiments, coverage areas can vary to include distal, middle, and proximal phalanx of the fingers.

The grip pads are interchangeable and replaceable. The grip pads also can include at least one anchor disposed upon the fitted protective covering to secure the at least one grip pad to the fitted protective covering of the glove 10. Each anchor can be one of hook and loop fasteners. Each grip pad can be one of hook and loop fasteners, opposite of the anchors, such that the grip pad is securely attachable and interchangeable to the anchor on the glove. By way of example, grip pad 16 attaches to anchor 46; grip pad 18 attaches to anchor 48; grip pad 20 attaches to anchor 50; grip pad 22 attaches to anchor 52; grip pad 24 attaches to anchor 54; grip pad 26 attaches to anchor 56; grip pad 28 attaches to anchor 58; and grip pad 30 attaches to anchor 60. As depicted hook and loop fasteners, such as industrial Velcro® are used. However, alternative means of attachment in alternative embodiments includes snap in, slip in, insets, permanent attachment, and temporary seals.

The glove 10 includes a wrist strap wrap 14. The wrist strap wrap 14 is anchored to the glove as base 32 and strap locking mechanism 36. The wrist strap wrap 14 is adapted to securely hold the glove 10 on the wearer such that the glove 10 is not pulled from the wearer in use when trying to break or impede the fall. As such the wrist strap wrap 14 is manufactured of a very strong material, such as leather or man-made material, that can securely wrap and tie the glove 10 onto the wearer such that the glove 10 does not come off when pulled or under other strong force.

In use the glove 10 provides for added safety and protection to a wearer such as a roofer. By way of example, a roofer can wear the glove 10 and perform normal roofing tasks all the while accessibility to the spikes 12*a*, 12*b*, 12*c*, 12*d*, and the like, and accessibility to the grip pads 16-30, and the like, is nearly immediate should the roofer need to break or cease a fall. As a roofer starts to fall, slide, or otherwise feel jeopardized while on a roof with a hazardous incline, for example, the roofer can immediately thrust his or her hands, bearing these gloves 10, downwardly onto the roof, shingles, or material present on the roof at the time, and engage the grip pads and spikes into the roof to stop the fall or slide. Even when not in jeopardy, the grip pads are useful to a roofer to gain traction while working on a surface such as an inclined roof.

Although this technology has been illustrated and described herein with reference to preferred embodiments and specific examples thereof, it will be readily apparent to those of ordinary skill in the art that other embodiments and examples can perform similar functions and/or achieve like results. All such equivalent embodiments and examples are within the spirit and scope of the invention and are intended to be covered by the following claims.

What is claimed is:

1. A glove comprising:

a fitted five-finger protective covering receivable to a hand of a wearer;

the glove consisting of spikes disposed only on a lower palmar side of the glove to correspond to the lower palmar regions over the thenar and hypothenar of an inserted hand, the spikes disposed only on the lower palmar side of the glove consisting of a first anchor, a first sharp protrusion extended from the glove and narrowed at a first distal tip, the first sharp protrusion consisting of a first curvature, curved upwardly in a direction toward a fingertip area, the spikes disposed only on the lower palmar side of the glove designed to break a fall and cease a slide on a sloped surface;

the glove further consisting of spikes disposed only on an outermost edge of an ulnar side of the glove to correspond to the outermost edge of the ulnar side situated below fingers and above wrist of the inserted hand, the spikes disposed only on the outermost edge of ulnar side of the glove consisting of a second anchor, a second sharp protrusion extended from the glove and narrowed at a second distal tip, the second sharp protrusion consisting of a second curvature, curved downwardly in a direction toward a wrist area, the spikes disposed only on the outermost edge of ulnar side of the glove designed to break a fall and cease a slide on a sloped surface;

at least one grip pad disposed upon the fitted five-finger protective covering at a predetermined location, wherein said at least one grip pad further comprises at least one additional anchor; and a wrist strap wrap;

wherein the spikes disposed only on the lower palmar side of the glove and only on the outermost edge of an ulnar side of the glove and the at least one grip pad are designed to grip a surface upon a fall by the wearer of the glove to prevent further fall or slide; and wherein the wrist strap wrap is configured to securely hold the glove on the wearer such that the glove is not pulled from the wearer in use when trying to break or impede the fall; and wherein any region other than the lower palmar side of the glove corresponding to the lower palmar regions over the thenar and hypothenar of the inserted hand and the outermost edge of the ulnar side of the glove corresponding to the outermost edge of the ulnar side situated below the fingers and above the wrist of the inserted hand contain no spikes.

2. The glove of claim 1, wherein the spikes disposed only on the lower palmar side of the glove corresponding to the lower palmar regions over the thenar and hypothenar of the inserted hand and the spikes disposed only on the outermost edge of an ulnar side of the glove corresponding to the outermost edge of the ulnar side situated below fingers and above wrist of the inserted hand are interchangeable and replaceable.

3. The glove of claim 1, wherein the spikes disposed only on the lower palmar side of the glove corresponding to the lower palmar regions over the thenar and hypothenar of the inserted hand and the spikes disposed on the outermost edge of the ulnar side of the glove to correspond to the outermost edge of the ulnar side situated below fingers and above wrist of the inserted hand further consists of a fastener pin separable from a backing having a base, wherein the fastener pin is configured for access through a material to secure the spikes disposed only on the lower palmar side of the glove and the spikes disposed only on the outermost edge of the ulnar side of the glove to the base located on an opposite side of the material.

4. The glove of claim 1, wherein the at least one grip pad is interchangeable and replaceable.

5. The glove of claim 1, further comprising: wherein the at least one additional anchor is disposed upon the fitted five-finger protective covering to secure the at least one grip pad to the fitted five-finger protective covering of the glove.

6. The glove of claim 5, wherein the at least one additional anchor comprises one of hook and loop fasteners, and wherein the at least one grip pad comprises one of hook and loop fasteners, opposite of the at least one additional anchor, such that the at least one grip pad is securely attachable and interchangeable to the at least one additional anchor on the glove.

7. A roofing glove configured for fall prevention and fall cessation, the roofing glove comprising:

a fitted five-finger protective covering receivable to a hand of a user with a separate sheath for each finger and the thumb;

the glove consisting of palmar spikes disposed only on a lower palmar side of the glove to correspond to the lower palmar regions over the thenar and hypothenar of an inserted hand, the palmar spikes consisting of a first anchor, a first sharp protrusion extended from the glove and narrowed at a first distal tip, the first sharp protrusion consisting of a first curvature, curved upwardly in a direction toward a fingertip area, the palmar spikes designed to break a fall and cease a slide on a sloped surface;

the glove further consisting of ulnar spikes disposed only on an outermost edge of an ulnar side of the glove to correspond to the outermost edge of the ulnar side situated below fingers and above wrist of the inserted hand, the ulnar spikes consisting of a second anchor, a second sharp protrusion extended from the glove and narrowed at a second distal tip, the second sharp protrusion consisting of a second curvature, curved downwardly in a direction toward a wrist area, the ulnar spikes designed to break a fall and cease a slide on a sloped surface;

at least one grip pad disposed upon the fitted five-finger protective covering, wherein said at least one grip pad further comprises at least one additional anchor; and wherein any region other than the lower palmar side of the glove corresponding to the lower palmar regions over the thenar and hypothenar of the inserted hand and the outermost edge of the ulnar side of the glove corresponding to the outermost edge of an ulnar side situated below the fingers and above the wrist of the inserted hand contain no spikes.

8. The roofing glove of claim 7, wherein the palmar spikes and the ulnar spikes are both interchangeable and replaceable.

9. The roofing glove of claim 7, wherein the palmar spikes and the ulnar spikes each further consist of a fastener pin separable from a backing having a base, wherein the fastener pin is configured for access through a material to secure the palmar spikes and the ulnar spikes to the base located on an opposite side of the material.

10. The roofing glove of claim 7, wherein the at least one grip pad is interchangeable and replaceable.

11. The roofing glove of claim 7, further comprising: wherein the at least one additional anchor is disposed upon the fitted five-finger protective covering to secure the at least one grip pad to the fitted five-finger protective covering of the glove.

12. The roofing glove of claim 11, wherein the at least one additional anchor comprises one of hook and loop fasteners, and wherein the at least one grip pad comprises one of hook and loop fasteners, opposite of the at least one additional anchor, such that the at least one grip pad is securely attachable and interchangeable to the at least one additional anchor on the glove.

13. A method for fall prevention and cessation on a roof, the method comprising:

providing a five-finger glove structure having a fitted protective covering receivable to a hand of a user with a separate sheath for each finger and the thumb, the glove consisting of palmar spikes disposed only on a lower palmar side of the glove to correspond to the lower palmar regions over the thenar and hypothenar of an inserted hand, the palmar spikes consisting of a first anchor, a first sharp protrusion extended from the glove and narrowed at a first distal tip, the first sharp protrusion consisting of a first curvature, curved upwardly in a direction toward a fingertip area, the palmar spikes designed to break a fall and cease a slide on a sloped surface, the glove further consisting of ulnar spikes disposed only on an outermost edge of an ulnar side of the glove to correspond to the outermost edge of the ulnar side situated below fingers and above wrist of the inserted hand, the ulnar spikes consisting of a second anchor, a second sharp protrusion extended from the glove and narrowed at a second distal tip, the second sharp protrusion consisting of a second curvature, curved downwardly in a direction toward a wrist area, the ulnar spikes designed to break a fall and cease a slide on a sloped surface;

wherein any region of the glove other than the lower palmar side of the glove corresponding to the lower palmar regions over the thenar and hypothenar of the inserted hand and the outermost edge of an ulnar side of the glove corresponding to the outermost edge of the ulnar side situated below the fingers and above the wrist of the inserted hand contain no spikes; and utilizing, upon a fall or slide, the glove, the palmar or ulnar spikes, and at least one grip pad to break or cease the fall.

14. The method of claim 13, further comprising: inhibiting further slide on a sloped surface by embedding the palmar or ulnar spikes into the sloped surface.

15. The method of claim 13, further comprising: inhibiting further slide on a sloped surface by applying the at least one grip pad directly to the sloped surface.

* * * * *